US005909019A

United States Patent [19]

Maloney et al.

[11] Patent Number: 5,909,019

[45] Date of Patent: Jun. 1, 1999

[54] FRONT MOUNTING PLATE WITH INTEGRAL LOCKING TAB

[75] Inventors: James G. Maloney, Industry; Michael J. Whipple, New Sewickley Township, both of Pa.

[73] Assignee: Eaton Corporation, Cleveland, Ohio

[21] Appl. No.: 09/000,659

[22] Filed: Dec. 30, 1997

[51] Int. Cl.[6] ..... H01H 9/28

[52] U.S. Cl. ..... 200/43.14

[58] Field of Search ..... 200/43.14, 43.13, 200/296, 50.11

[56] References Cited

U.S. PATENT DOCUMENTS

| | | | |
|---|---|---|---|
| 1,321,645 | 11/1919 | Klein | 200/43.14 |
| 1,550,031 | 8/1925 | Kovar et al. . | |
| 2,983,799 | 5/1961 | Osieja et al. | 200/42 |
| 3,213,213 | 10/1965 | De Smidt | 200/296 X |
| 3,214,530 | 10/1965 | Tharp et al. | 200/42 |
| 3,291,924 | 12/1966 | Tharp | 200/42 |
| 4,260,861 | 4/1981 | DiMarco | 200/42 |
| 4,454,565 | 6/1984 | Krasij et al. | 200/296 X |
| 4,677,261 | 6/1987 | Nourry | 200/43.15 |
| 5,207,315 | 5/1993 | Benda | 200/43.11 |

OTHER PUBLICATIONS

Westinghouse I.S. 15172–B, "Instructions for 1–2 and 3 Pole Quicklag Circuit Breaker", 1 page. (No Date).

*Primary Examiner*—Renee S. Luebke

*Attorney, Agent, or Firm*—Martin J. Moran

[57] ABSTRACT

A front mounting plate with integral locking tab for mounting an electrical switch to a support and for locking an operating handle of the electrical switch in a selected position. The front mounting plate includes a body having a cutout portion through which the operating handle of the electrical switch extends. The locking tab extends generally upwardly from the body and is positioned adjacent the cut-out portion and the operating handle so that a conventional padlock may be inserted through a lock receiving aperture of the locking tab to resist movement of the operating handle. The body of the front mounting plate includes first and second side projections and first and second end projections extending generally downwardly therefrom and overlays a raised escutcheon formed on a front surface of the electrical switch. The front mounting plate also includes first and second end flanges extending generally outwardly from the respective first and second end projections so as to provide a means for mounting the front mounting plate to a support. A fixed tab and a deformable tab extend generally inwardly from the first and second end flanges, respectively, so as to provide a means for attaching the front mounting plate to the electrical switch.

5 Claims, 4 Drawing Sheets

FRONT MOUNTING PLATE WITH INTEGRAL LOCKING TAB

BACKGROUND OF THE INVENTION

1. Field of the Invention

This invention relates generally to a front mounting plate for mounting an electrical switch to a support, and more particularly, to a front mounting plate having an integral locking tab for locking an operating handle of the electrical switch in a selected position.

2. Background Information

Generally, an electrical switch for use with various devices, such as a circuit breaker, electrical contactors, or motor controllers, has an extended operating handle moveable between an "on" and an "off" position for the electrical switch.

It is known to mount an electrical switch on a support, such as an electrical panel, using a front mounting plate which is attached to the front of the electrical switch and then mounted to the support. An example of a known front mounting plate arrangement for mounting an electrical switch is shown in FIGS. 1 and 1A of the accompanying drawings. The front mounting plate 10 is shown as being attached to a front surface 11 of an electrical switch, which in this instance is a circuit breaker 12. As shown, an edge portion 14 of the front mounting plate 10 extends beyond the front surface 11 of the circuit breaker 12 and the same is true for the other edge portion 15. Of course, this makes the front mounting plate 10 wider than the front surface 11 of the circuit breaker 12. This creates a problem when attempting to stack a plurality of circuit breakers side-by-side, which is commonly done in known electrical panel arrangements. The edge portions 14, 15 of the front mounting plate 10, which extend beyond the front surface 11 of the circuit breaker 12, prevents additional circuit breakers from being stacked side-by-side with circuit breaker 12.

It is also known to provide electrical switches with a locking device so that once the operating handle is moved to the selected position, it is prevented for safety purposes from being moved again. Examples of such locking devices are disclosed in, for example, U.S. Pat. Nos. 3,214,530, 3,291,924 and 4,260,861. These patents show locking devices for resisting movement of the operating handle wherein the locking devices are mounted to the electrical switches adjacent the operating handles. A conventional padlock is utilized in association with the locking devices so as to lock the operating handle in the selected operating position. However, the locking devices disclosed in these patents do not provide, nor do any other locking devices that we are aware of, a locking device that may be adapted for use with an electrical switch that is mounted using a front mounting plate, such as described above. One reason no such locking device is known is that the locking device and the front mounting plate would both occupy the same area adjacent the operating handle of the electrical switch.

There is a need, therefore, for an improved front mounting plate for mounting an electrical switch to a support which overcomes the above-described limitations and disadvantages of the prior art.

There is also a need for a front mounting plate for mounting an electrical switch to a support which allows for a plurality of electrical switches to be mounted in a side-by-side, stackable arrangement.

There is a further need for a front mounting plate for mounting an electrical switch to a support which includes an integral locking tab for locking an operating handle of the electrical switch in a selected position.

There is yet a further need for a front mounting plate for mounting an electrical switch to a support having an integral locking tab which is configured to be used with known electrical switch designs.

SUMMARY OF THE INVENTION

These and other needs are satisfied by the present invention which is directed to an improved front mounting plate for mounting an electrical switch to a support, as well as, for locking an operating handle of the electrical switch in a selected position.

Specifically, the front mounting plate of the present invention includes a body having a cut-out portion extending therethrough. Preferably, the front mounting plate is positioned on a front surface of the electrical switch so that the operating handle of the electrical switch extends through the cut-out portion of the body. The body of the front mounting plate further includes a lock tab having a lock receiving aperture. The lock tab extends generally perpendicularly from the body of the front mounting plate and is positioned so as to be adjacent the cut-out portion and the operating handle which extends therethrough. As will be appreciated, a conventional padlock may be inserted through the lock receiving aperture of the lock tab so as to resist movement of the operating handle. Advantageously, by providing for the front mounting plate to have an integrally formed lock tab, electrical switches which are mounted utilizing the front mounting plate may also have the operating handle locked in a selected position.

The body of the front mounting plate also includes first and second end projections extending generally perpendicularly from the body. The body also includes first and second side projections extending generally perpendicularly from the body. As will be appreciated, the body of the mounting plate is formed so as to overlay a raised escutcheon which is formed on the front surface of the electrical switch adjacent the operating handle. Preferably, the raised escutcheon has a width less than a width of the front surface of the electrical switch. By providing for a raised escutcheon of less width than the front surface of the electrical switch, first and second setbacks are formed by the opposing sides of the raised escutcheon and the front surface of the electrical switch. Preferably, the first and second setbacks extend the length of the raised escutcheon and receive the first and second side projections of the body once the front mounting plate is attached to the electrical switch. Advantageously, this allows for the front mounting plate to have a width equal to or less than the width of the front surface of the electrical switch so that electrical switches employing the front mounting plate may be mounted side-by-side.

The front mounting plate of the present invention also includes attachment means for attaching the front mounting plate to the electrical switch and mounting means for mounting the front mounting plate to a support, such as an electrical panel. The mounting means includes first and second end flanges connected to the first and second end projections, respectively, of the body, wherein the first and second end flanges extend generally outwardly from the first and second end projections. The attachment means includes a fixed tab connected to the first end flange and a deformable tab connected to the second end flange. The fixed tab and deformable tab extend generally inwardly from the respective first and second end flanges and are received in first and second slots which are preferably formed in opposing ends of the raised escutcheon. The fixed tab and deformable tab preferably extend sufficiently inward so as to be beneath the body of the front mounting plate.

In a further embodiment, the front mounting plate of the present invention may be expanded so as to accommodate mounting of an electrical switch having multiple poles, as well as, for locking the operating handles associated with each pole in a uniform selected position. This embodiment of the front mounting plate is essentially as described herein, except that the cut-out portion is expanded so that all operating handles, which are interconnected by a handle-tie, can extend therethrough. The handle-tie enables the operating handles to be moved in unison to a selected position. The lock tab extending generally perpendicularly from the body of the front mounting plate remains positioned adjacent the cut-out portion of the body and is also positioned adjacent the handle-tie which interconnects the operating handles. As will be appreciated, by resisting movement of the handle-tie, then movement of all operating handles is resisted simultaneously.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 5:
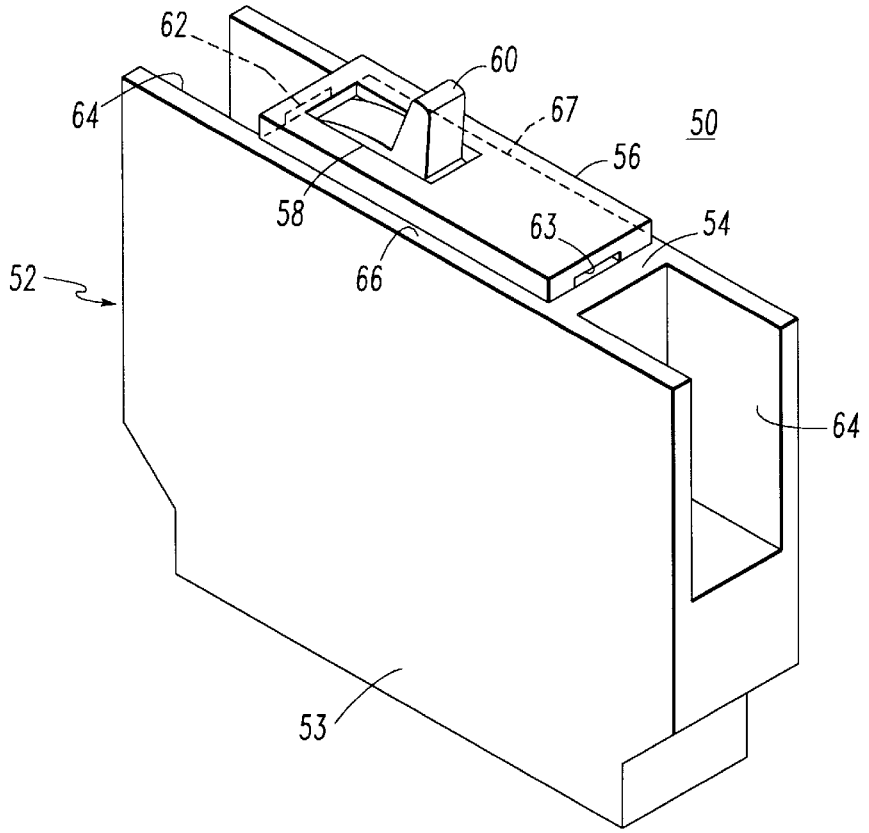
FIG.5 PRIOR ART
FIG. 5 is a perspective view of a prior art electrical switch, e.g., a circuit breaker, which may be mounted to a support utilizing the front mounting plate of the present invention.

As is generally known, an electrical switch may be used in association with various devices. The present invention will be described as applied to a circuit breaker 50, as shown in FIG. 5. The circuit breaker 50 may be of a type circuit breaker as is generally known in the art and generally referred to as a "miniature" circuit breaker which is commonly used in many household electrical systems for providing overcurrent protection.

Figure 1:
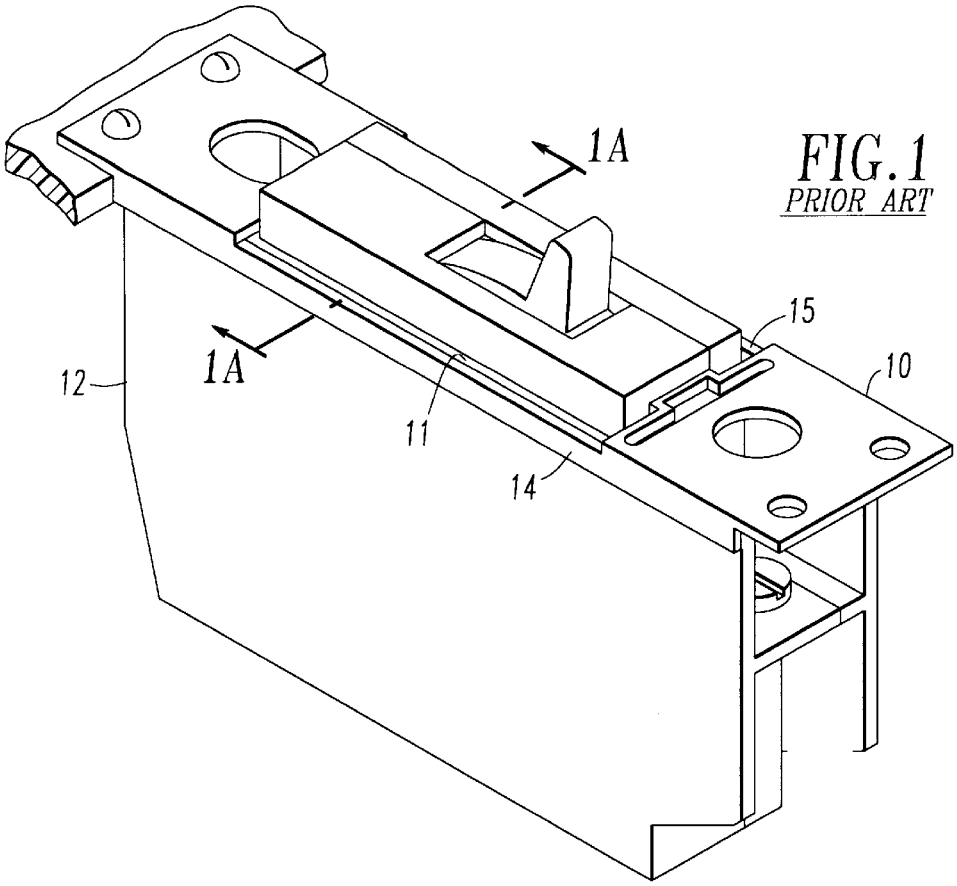
FIG. 1 PRIOR ART
FIG. 1 is a perspective view of a prior art front mounting plate for mounting an electrical switch, e.g., a circuit breaker.
Figure 1A:
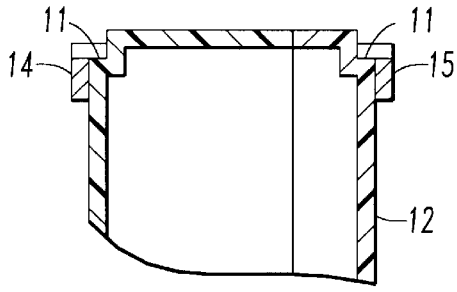
FIG. 1A PRIOR ART
FIG. 1A is a sectional view taken along line 1A—1A of FIG. 1.
Figure 2:
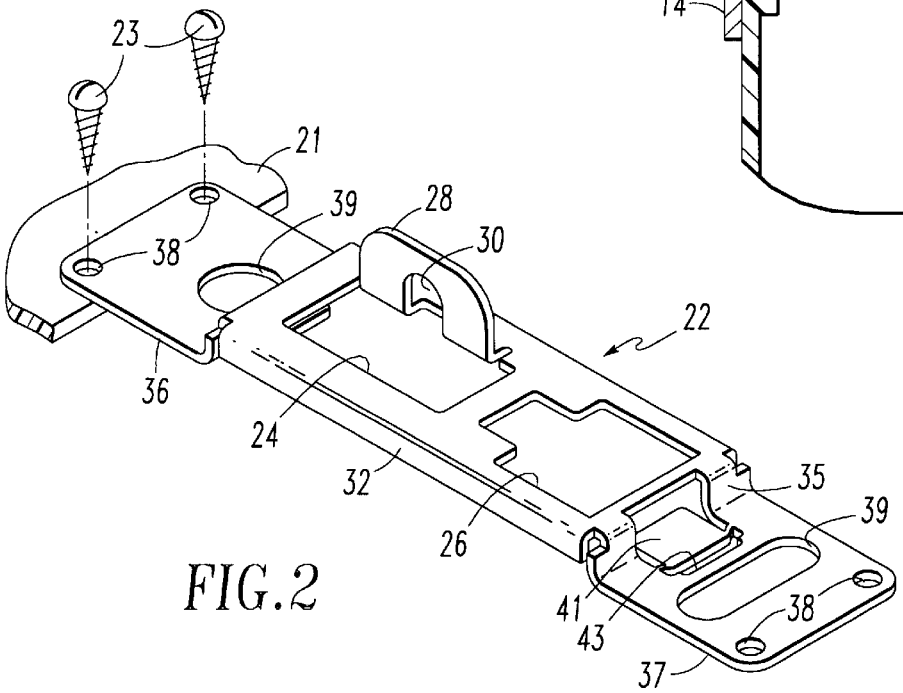
FIG. 2 perspective view of a front mounting plate in accordance with the present invention.
Figure 3:
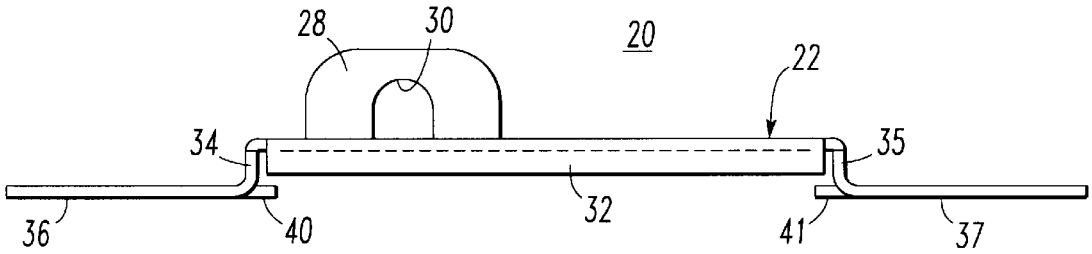
FIG. 3 is a side view of the front mounting plate shown in FIG. 2.
Figure 4:
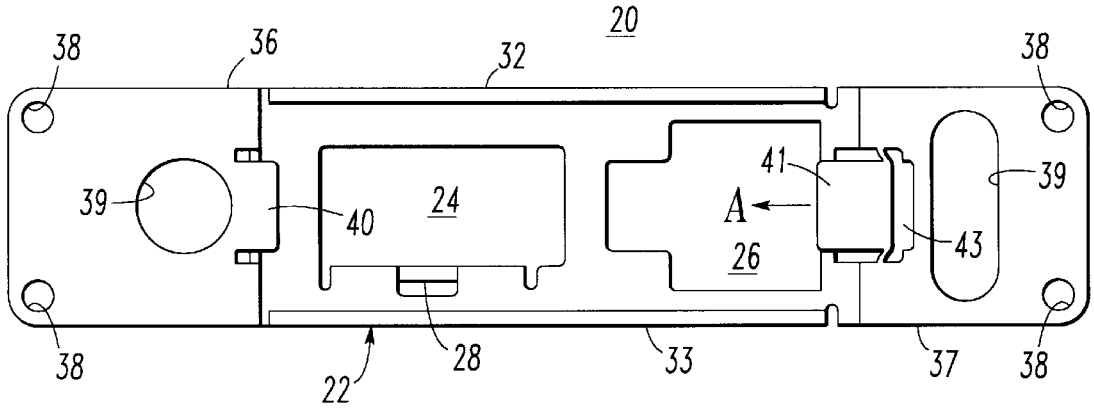
FIG. 4 is a rear view of the front mounting plate shown in FIG. 2.

With reference to FIGS. 2–4, there is shown a front mounting plate 20 for mounting an electrical switch to a support 21, such as an electrical panel. The front mounting plate 20 also provides for locking an operating handle of the electrical switch in a selected position, as will be described in detail herein. The front mounting plate 20 includes a body, generally indicated by reference numeral 22. The body includes a cut-out portion 24 extending through the body 22, and may optionally include an additional cut-out portion 26 also extending through the body 22. The body 22 further includes a lock tab 28 having a lock receiving aperture 30 extending therethrough. The lock tab 28 preferably extends generally perpendicularly from the body 22 and is positioned so as to be adjacent the cut-out portion 24.

The body 22 further includes first and second side projections 32, 33 which extend generally perpendicularly therefrom. Additionally, the body 22 includes first and second end projections 34, 35 also extending generally perpendicularly therefrom.

In order to provide a means for mounting the front mounting plate 20 to the support 21, the front mounting plate 20 also includes first and second end flanges 36, 37. The first and second end flanges 36, 37 are connected to the first and second end projections 34, 35, respectively, and extend generally outwardly from the first and second end projections 34, 35 in a plane parallel to the plane of the body 22. As is known, first and second end flanges 36, 37 may include one or more mounting apertures 38 for receiving mechanical fasteners, such as screws 23, for securing the front mounting plate 20 to the support 21. As also is known, first and second end flanges 36, 37 may include one or more terminal access openings 39 so that the terminals of circuit breaker 50 may be accessed once the front mounting plate 20 is attached to the circuit breaker 50. As shown, terminal access openings 39 may be of any desired shape, such as, for example, circular, oval or rectangular.

Front mounting plate 20 also includes a fixed tab 40 which is connected to the first end flange 36 and extends generally inwardly therefrom. A deformable tab 41 is connected to the second end flange 37 and extends generally inwardly therefrom. As will be appreciated, the fixed tab 40 and deformable tab 41 provide a means for attaching the front mounting plate 20 to the circuit breaker 50, as will be described in more detail herein. A deformable slot 43 is formed in the second end flange 37 adjacent the deformable tab 41. By inserting, for example, the head of a screwdriver into the deformable slot 43 and prying against the deformable tab 41, the deformable tab 41 may be deformed or moved inwardly as indicated by arrow A (see FIG. 4). The fixed tab 40 and deformable tab 41 preferably extend inwardly so as to be beneath the body 22. As will be appreciated, this provides for securely attaching the front mounting plate 20 to the circuit breaker 50, as will be described in more detail herein.

Referring to FIG. 5, circuit breaker 50, as is known, includes an electrically insulating housing 52 having a front surface 54 and side surfaces 53,55. The housing 52 includes a raised escutcheon 56 formed on the front surface 54. An aperture 58 extends through the front surface 54 and raised escutcheon 56. An operating handle 60 extends through the aperture 58 and is moveable between an "off" and an "on" position. Raised escutcheon 56 includes first and second slots 62, 63 formed in opposing ends thereof. As will be appreciated, the fixed tab 40 is received in the first slot 62 and the deformable tab 41 is received in the second slot 63 for attaching the front mounting plate 20 to the circuit breaker 50. The circuit breaker 50 also includes terminal areas 64 where the terminals (not shown) of the circuit breaker 50 are located.

Preferably, the raised escutcheon 56 has a width less than a width of the front surface 54 of housing 52. As a result of the width of the raised escutcheon 56 being less than the width of the front surface 54, first and second setbacks 66, 67 are formed on the front surface 54 along the sides of the raised escutcheon 56. Preferably, the first and second setbacks 66, 67 extend the length of the raised escutcheon 56.

Figure 6:
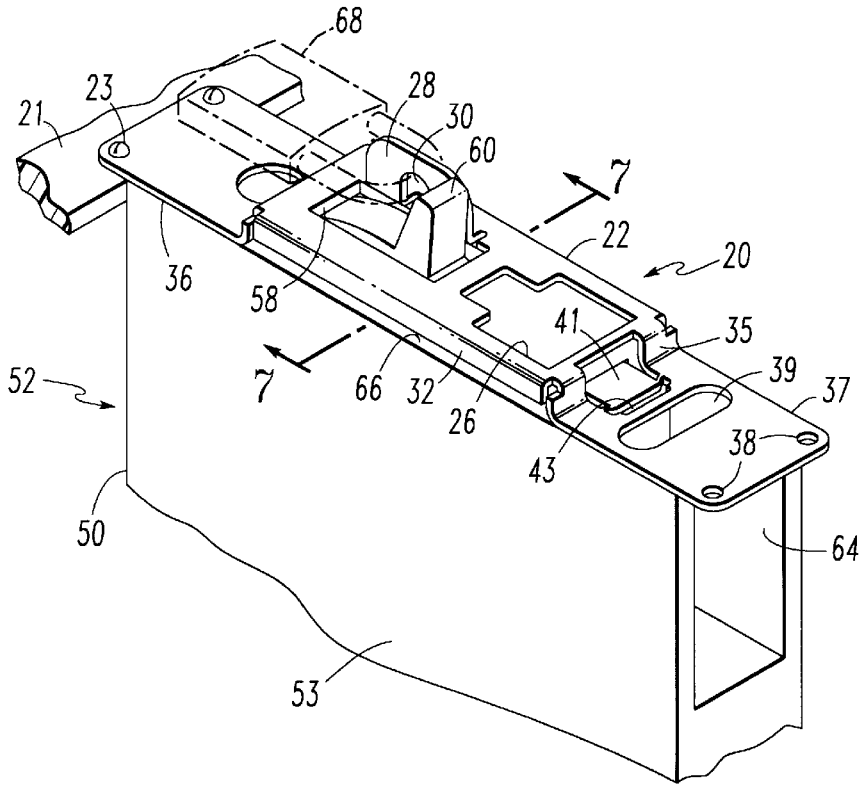
FIG. 6 is a perspective view showing the front mounting plate of the present invention as attached to the circuit breaker shown in FIG. 5.
Figure 7:
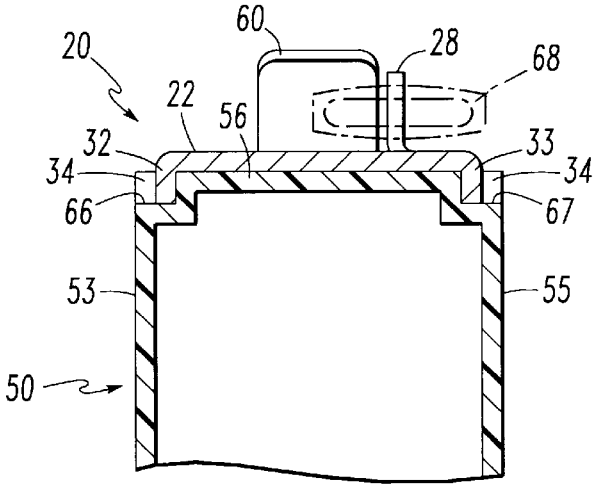
FIG. 7 a sectional view taken along line 7—7 of FIG. 6.

Referring to FIGS. 6 and 7, the front mounting plate 20 is shown as attached to the circuit breaker 50. In accordance with an important aspect of the present invention, the body 22 of the front mounting plate 20 is formed so as to overlay the raised escutcheon 56. In addition, the front mounting plate 20 has a width equal to or less than the width of the front surface 54 of housing 52. Advantageously, as best shown in FIG. 7, this prevents the front mounting plate 20 from extending laterally beyond the front surface 54 so that a plurality of circuit breakers 50 having front mounting plates 20 may be mounted side-by-side with direct abutment against the side surfaces 53, 54. Preferably, the front mounting plate 20 is attached to the circuit breaker 50 in a manner so that the first side projection 32 of the body 22 is received in the first setback 66. Similarly, the second side projection 33 is received in the second setback 67.

As previously described, fixed tab 40 is received in first slot 62 of the raised escutcheon 56 and the deformable tab 41 is received in the second slot 63. Once the fixed tab 40 and deformable tab 41 are inserted in the respective slots 62, 63, the deformable tab 41 is deformed or moved inwardly in the direction of arrow A (see FIG. 4) in order to securely attach the front mounting plate 20 to the circuit breaker 50. The circuit breaker 50 having the front mounting plate 20 securely attached thereto may then be mounted to the support 21 using screws 23 which are inserted through mounting apertures 38 which, as shown, extend beyond the ends of the circuit breaker 50 to accommodate the mounting. Also, it will be appreciated that terminal access openings 39 of the front mounting plate 20 are positioned so as to expose the terminal areas 64 formed in the ends of the circuit breaker 50. The additional cut-out portion 26 may be provided in the body 22 of the front mounting plate 20 so that once the front mounting plate 20 is secured to the circuit breaker 50 a trip window or test button (not shown) extending through the raised escutcheon 56 may be exposed and/or accessed through the cut-out portion 26.

As shown in FIG. 6, the lock tab 28 of the front mounting plate 20 is positioned adjacent the operating handle 60 of circuit breaker 50. Advantageously, this allows for a padlock 68, shown in phantom line in FIG. 6, to be inserted through the lock receiving aperture 30 for locking the operating handle 60 in a selected position. As can appreciated, the padlock 68 prevents the operating handle 60 from being moved. It will also be appreciated that the lock tab 28 may be formed on body 22 of the front mounting plate 20 so as to lock the operating handle 60 in any selected position.

Preferably, the front mounting plate 20 is manufactured from a single piece of material which results in the reduction of manufacturing costs. Specifically, waste of raw materials is reduced, for example, by forming the lock tab 28 out of the material which is necessarily removed to form the cut-out portion 24. Also, fixed tab 40 and deformable tab 41 are advantageously formed from a portion of the material that otherwise would make up the first and second end projections 34, 35 respectively.

Figure 8:
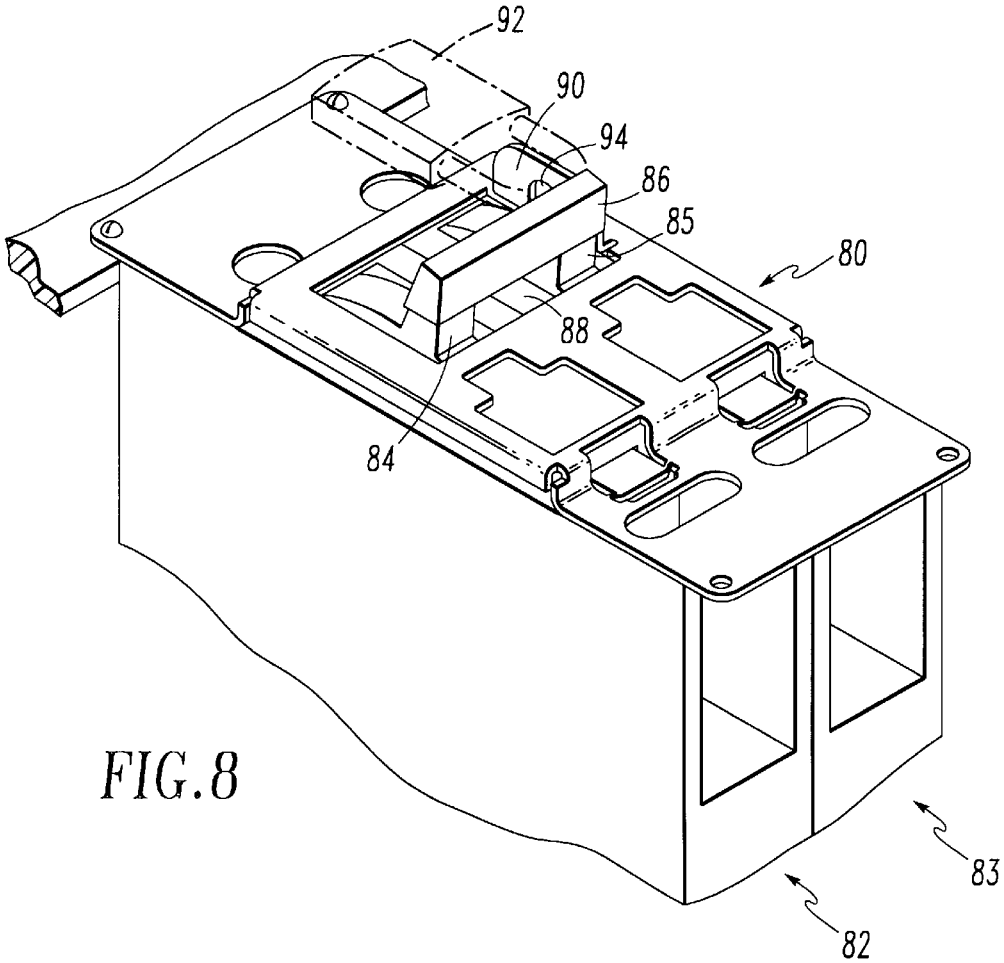
FIG. 8 is a perspective view of a further embodiment of a front mounting plate in accordance with the present invention.

Referring to FIG. 8, there is shown a further embodiment of the present invention. Specifically, an electrical switch assembly includes a front mounting plate 80 for mounting a pair of interconnected circuit breakers 82, 83. Circuit breakers 82, 83 include respective operating handles 84, 85 which are interconnected by a handle-tie 86, as is known. The handle-tie 86 provides for the operating handles 84, 85 to be moved in unison to a selected position.

The front mounting plate 80 is similar to the previously described front mounting plate 20. Cut-out portion 88 is enlarged so that operating handles 84, 85 and the handle-tie 86 may extend upwardly therethrough. Lock tab 90 is positioned adjacent the cut-out portion 88 so that a padlock 92, shown in phantom line, may be inserted through lock receiving aperture 94 to resist movement of the handle-tie 86 once the operating handles 82, 83 are moved to a selected position. It will appreciated that the concept of the present invention may be applied to any number of interconnected circuit breakers having a handle-tie 86 interconnecting the operating handles of the circuit breakers.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A front mounting plate for mounting an electrical switch to a support and for locking an operating handle of the electrical switch in a selected position, comprising:

a body;

said body including a cut-out portion extending therethrough, the operating handle extending through said cut-out portion;

said body further including a lock tab having a lock receiving aperture, said lock tab extending generally perpendicularly from said body and positioned adjacent said cut-out portion and the operating handle;

attachment means for attaching the front mounting plate to the electrical switch; and mounting means for mounting the front mounting plate to the support;

wherein said body includes first and second end projections extending generally perpendicularly from said body; and said mounting means includes first and second end flanges connected to said first and second end projections respectively, said first and second end flanges extending generally outwardly from said first and second end projections.

2. The front mounting plate of claim 1 wherein said attachment means includes:

a fixed tab connected to said first end flange and extending generally inwardly therefrom; and a deformable tab connected to said second end flange and extending generally inwardly therefrom;

whereby said fixed tab and said deformable tab are received in slots formed in a housing of the electrical switch.

3. The front mounting plate of claim 2 wherein said body further includes first and second side projections extending generally perpendicularly therefrom.

4. An electrical switch assembly for mounting an electrical switch to a support and for locking the electrical switch in a selected position, comprising:

a housing, said housing including a front surface having an aperture extending therethrough;

an operating handle, said operating handle extending through said aperture and movable between an off and an on position;

a front mounting plate comprising:

a body;

said body including a cut-out portion extending therethrough, said operating handle extending through said cut-out portion;

said body further including a lock tab having a lock receiving aperture, said lock tab extending generally perpendicularly from said body and positioned adjacent said cut-out portion and said operating handle;

attachment means for attaching the front mounting plate to the front surface of the electrical switch;

mounting means for mounting the front mounting plate to the support;

wherein said housing includes a raised escutcheon formed on said front surface thereof and adjacent said aperture, said body of the front mounting plate formed to overlay the raised escutcheon;

wherein said body includes first and second end projections extending generally perpendicularly therefrom, said first and second end projections positioned adjacent opposing ends of said raised escutcheon;

wherein first and second setbacks are formed by the opposing sides of said raised escutcheon and said front surface of said housing;

wherein said body includes first and second side projections extending generally perpendicularly therefrom, said first and second side projections being received in the first and second setbacks respectively;

wherein said raised escutcheon includes first and second slots formed in said opposing ends thereof;

wherein said mounting means includes first and second end flanges connected to said first and second end projections respectively, said first and second end flanges extending generally outwardly from said first and second end projections;

wherein said attachment means comprises:

a fixed tab connected to said first end flange and extending generally inwardly therefrom, said fixed tab received in said first slot; and a deformable tab connected to said second end flange and extending generally inwardly therefrom, said deformable tab received in said second slot.

5. The assembly of claim 4 wherein said fixed tab and said deformable tab extend beneath said body.

* * * * *